US006601323B2

(12) United States Patent
Tsujino et al.

(10) Patent No.: US 6,601,323 B2
(45) Date of Patent: Aug. 5, 2003

(54) SHOELACE COVER

(75) Inventors: Kanzo Tsujino, Orange, CA (US); Urban Geiwald, Seattle, WA (US); Thomas M. Lukens, Edmonds, WA (US)

(73) Assignee: Asics Corporation, Kobe (JP)

( * ) Notice: Subject to any disclaimer, the term of this patent is extended or adjusted under 35 U.S.C. 154(b) by 92 days.

(21) Appl. No.: 10/002,637

(22) Filed: Oct. 26, 2001

(65) Prior Publication Data

US 2002/0083620 A1 Jul. 4, 2002

Related U.S. Application Data

(60) Provisional application No. 60/244,865, filed on Nov. 2, 2000.

(51) Int. Cl.[7] ..... A43C 9/00; A43B 11/00

(52) U.S. Cl. ..... 36/136; 36/1.5; 24/712.3

(58) Field of Search ..... 36/1.5, 2 R, 136, 36/50.1; 24/712.1, 712.2, 712.3

(56) References Cited

U.S. PATENT DOCUMENTS

| | | | | | |
|---|---|---|---|---|---|
| 776,767 | A | * | 12/1904 | Waters | 36/54 |
| 1,572,313 | A | * | 2/1926 | Sarar | 36/1.5 |
| 1,725,597 | A | * | 8/1929 | Rogers | 36/1.5 |
| 2,346,415 | A | | 4/1944 | Clein et al. | |
| 3,473,198 | A | | 10/1969 | Meier | |
| 3,481,055 | A | | 12/1969 | Herman | |
| 4,282,657 | A | | 8/1981 | Antonious | |
| 4,296,558 | A | | 10/1981 | Antonious | |
| 4,333,248 | A | | 6/1982 | Samuels | |
| D270,779 | S | | 10/1983 | Steinberg | |
| 4,507,882 | A | | 4/1985 | Harrell | |
| 4,547,982 | A | | 10/1985 | Gamm | |
| D281,926 | S | | 12/1985 | Hill | |
| D281,927 | S | | 12/1985 | Hill | |
| 4,571,856 | A | | 2/1986 | Lin et al. | |
| 4,577,419 | A | | 3/1986 | Chassaing | |
| D283,463 | S | | 4/1986 | Chassaing | |
| 4,630,383 | A | * | 12/1986 | Gamm | 36/136 |
| 4,640,025 | A | | 2/1987 | DeRenzo | |
| 4,676,011 | A | | 6/1987 | O'Rourke et al. | |
| 4,724,623 | A | | 2/1988 | Silverman | |
| 4,766,682 | A | | 8/1988 | Malloy, III | |
| 4,780,936 | A | | 11/1988 | Brecher | |
| 4,790,048 | A | | 12/1988 | Arnt | |
| 4,879,787 | A | | 11/1989 | Walls | |
| 4,949,437 | A | | 8/1990 | Anderson | |
| 4,969,242 | A | | 11/1990 | Carlton, Sr. | |
| 4,999,888 | A | | 3/1991 | Miller | |
| D318,752 | S | | 8/1991 | Jimenez | |
| 5,042,119 | A | | 8/1991 | Williams | |
| 5,109,614 | A | | 5/1992 | Curry | |
| D328,517 | S | | 8/1992 | Hallenbeck | |
| D337,425 | S | | 7/1993 | Hatfield | |

(List continued on next page.)

*Primary Examiner*—M. D. Patterson
(74) *Attorney, Agent, or Firm*—Michael Zall

(57) ABSTRACT

The present invention relates to a shoelace cover for use with an athletic shoe for covering the shoelaces to prevent the loosening or untying of a tied shoelace bow. The present invention is particularly applicable to wrestling shoes wherein the physical contact between wrestlers often causes the wrestling shoes to become untied. The shoelace cover generally includes a length of material with ends that can be interconnected to form an adjustable cuff for extending about one's ankle. A front portion includes apertures for shoelaces to extend through the cover. Preferably, the shoelaces extend from the shoe to pass through the apertures of the cover and then back to the shoe to secure the cover to the shoe. The front portion includes a pocket on a back side. The shoelaces can be tied into a shoelace bow, tucked into the pocket, and the ends of the cuff can be secured about one's ankle to retain the shoelace within the pocket under the cover.

6 Claims, 9 Drawing Sheets

U.S. PATENT DOCUMENTS

| | | | |
|---|---|---|---|
| D337,647 | S | 7/1993 | Cotsidas |
| D341,703 | S | 11/1993 | Hatfield et al. |
| D346,894 | S | 5/1994 | Hatfield |
| 5,307,569 | A | 5/1994 | Melcher |
| 5,311,679 | A | 5/1994 | Birch, Sr. |
| D349,807 | S | 8/1994 | Hatfield et al. |
| D350,013 | S | 8/1994 | Gitelman |
| D351,276 | S | 10/1994 | Gitelman |
| 5,351,370 | A | 10/1994 | Fields et al. |
| 5,402,589 | A | 4/1995 | Lubrani et al. |
| 5,416,987 | A | 5/1995 | Bemis et al. |
| 5,421,106 | A | 6/1995 | Emrick |
| 5,430,960 | A | 7/1995 | Richardson |
| 5,459,947 | A | 10/1995 | Lasher |
| D368,356 | S | 4/1996 | Reale |
| 5,566,477 | A | 10/1996 | Mathis et al. |
| D378,949 | S | 4/1997 | Lindaman |
| 5,671,517 | A | 9/1997 | Gourley |
| D385,102 | S | 10/1997 | Avar |
| D386,895 | S | 12/1997 | Hatfield |
| D388,245 | S | 12/1997 | Lindaman |
| 5,692,319 | A | 12/1997 | Parker et al. |
| 5,701,688 | A | 12/1997 | Crowley |
| 5,755,044 | A | 5/1998 | Veylupek |
| 5,771,608 | A | 6/1998 | Peterson |
| 5,778,500 | A | 7/1998 | Illingworth |
| 5,867,925 | A | 2/1999 | Fattori |
| 6,000,111 | A | 12/1999 | Deskins et al. |
| 6,449,881 | B1 * | 9/2002 | Assaf et al. ..... 36/136 |

* cited by examiner

SHOELACE COVER

RELATED APPLICATIONS

This application claims the benefit of Provisional Application U.S. Ser. No. 60/244,865 filed on Nov. 02, 2000, the entire disclosure of which is incorporated herein by reference.

BACKGROUND OF THE INVENTION

1. Field of the Invention

This invention generally relates to a shoelace cover for use in connection with an athletic shoe for covering a tied shoelace bow, and more particularly to a shoelace cover that can be worn with a wrestling shoe to prevent the shoelaces from becoming untied.

2. Related Art

Athletic shoes are generally secured to one's foot with shoelaces that crisscross the throat area of a shoe and which are tied into a bow knot at the upper end of the throat of the shoe. Unfortunately, during use, the tied shoelace bow can become loosened and/or untied. In sports where there is physical contact between the participants, such as wrestling, the tied shoelace bows often become untied and play must be suspended to allow the participants to re-tie the laces of their shoes.

There have been various attempts in the past at providing devices for preventing shoe laces from becoming untied. These efforts include:

Steinberg, U.S. Pat. No. Des. 270,779, discloses the design of a shoelace bow knot retainer which has two apertures for engagement with shoelaces and hook and pile fasteners at opposite long ends thereof for wrapping around a knot tied in the shoelaces.

Hill, U.S. Pat. No. Des. 281,926, discloses the ornamental design of an athletic shoe that includes upper straps extending across the upper tongue of the shoe, which can partially cover a bow knot tied in laces of the shoe.

Hill, U.S. Pat. No. Des. 281,927, discloses the ornamental design of an athletic shoe that includes upper straps extending across the upper tongue of the shoe and partially covering a bow knot tied in laces of the shoe.

Chassaing, U.S. Pat. No. Des. 283,463, discloses the ornamental design of an athletic shoe that includes an upper strap extending across the upper tongue of the shoe and partially covering a bow knot tied in laces of the shoe.

Jimenez, U.S. Pat. No. Des. 318,752, discloses the ornamental design of an athletic shoe that includes an upper strap extending across the upper tongue of the shoe and partially covering a bow knot tied in laces of the shoe.

Hallenbeck, U.S. Pat. No. Des. 328,517, discloses the ornamental design of an athletic shoe that includes an upper strap extending across the upper tongue of the shoe and partially covering a bow knot tied in laces of the shoe.

Hatfield, U.S. Pat. No. Des. 337,425, discloses the ornamental design of an athletic shoe including criss-crossing upper straps that extend across the upper tongue of the shoe partially covering a bow knot tied in laces of the shoe.

Cotsidas, U.S. Pat. No. Des. 337,647, discloses the ornamental design of an athletic shoe that includes an upper strap extending across the upper tongue of the shoe and partially covering a bow knot tied in laces of the shoe.

Hatfield, U.S. Pat. No. Des. 341,703, discloses the ornamental design of an athletic shoe that includes an upper strap extending back and forth across the upper tongue of the shoe and partially covering a bow knot tied in laces of the shoe.

Hatfield, U.S. Pat. No. Des. 346,894, discloses the ornamental design of an athletic shoe that includes a criss-crossing strap originating at one side of the shoe forefront, extending over the tongue area of the shoe around the rear foot of the shoe and back down across the tongue area of the shoe, and attaching to the forefront of the shoe on the opposite side.

Hatfield, U.S. Pat. No. Des. 349,807, discloses the ornamental design of an athletic shoe that includes a single upper strap extending about the opening in the upper of the shoe and partially covering a bow knot tied in the shoelaces.

Gitelman, U.S. Pat. No. Des. 350,013, discloses a sneaker with a cross strap that extends from a forefoot area on one side of the shoe to a rear foot area on the other side of the shoe, the strap extending over the tongue area of the shoe and partially covering the laces. Also disclosed is an upper strap that extends about the upper throat area of the shoe.

Gitelman, U.S. Pat. No. Des. 351,276, discloses a sneaker with a diagonal cross strap that extends from a forefoot area on one side of the shoe to a rear foot area on the other side of the shoe, the strap extending over the tongue area of the shoe and partially covering the laces. Also disclosed is an upper strap that extends about the upper throat area of the shoe.

Reale, U.S. Pat. No. Des. 368,356, discloses a decorative cover for sneakers that is engaged with a shoe along a lower edge using hook and pile-type fasteners, and which is interconnected over the tongue area of the shoe by straps extending across the throat of the shoe.

Lindaman, U.S. Pat. No. Des. 378,949, discloses a sock with loop and pile fasteners and capable of being folded over the top.

Avar, U.S. Pat. No. Des. 385,102, discloses an element for a shoe comprising three straps interconnected with side members. One strap extends about the bottom of the shoe, one strap extends about the rear of the shoe, and one strap extends about the upper throat of the shoe. The strap extending about the upper throat of the shoe partially covers shoelaces of the shoe.

Hatfield, U.S. Pat. No. Des. 386,895, discloses an element of a shoe comprising two straps, one of which extends about the rear of the shoe, and the other extends about the upper throat area of the shoe to partially cover a knot tied in the shoelace.

Lindaman, U.S. Pat. No. Des. 388,245, discloses a tube sock with a fastener.

Clein, et al., U.S. Pat. No. 2,346,415, discloses an article of footwear having a pump portion that can be embellished by attaching a second portion having a bow or buckle portion to the base pump portion. The second portion contains eyelets for threading shoelaces therethrough.

Meier, U.S. Pat. No. 3,473,198, discloses a shoe tie retainer including a retainer having two halves that can be pivoted and locked together by a latching means. One half contains apertures for inserting shoelaces therethrough. The shoelaces can be tied in a knot and the other half closed over the first half to retain the shoelaces within the closed retainer.

Herman, U.S. Pat. No. 3,481,055, discloses a baseball shoe safety protector comprising a hollow member that fits over the forward part of a baseball shoe, and is engaged with the shoe by threading shoelaces through apertures at an upper end thereof.

Antonious, U.S. Pat. No. 4,282,657, discloses a heel restraint with an adjustable and flexible closure assembly comprising a strap extending over the instep.

Antonious, U.S. Pat. No. 4,296,558, discloses an adjustable and flexible closure assembly for shoes with segmented uppers, including a strap that extends about the ankle instep, or waste portion, of the foot.

Samuels, U.S. Pat. No. 4,333,248, discloses a protective shoe having a protective cover extending over the instep and partially attached to the shoe at a forward edge of the shoe. The protective cover includes two zippers extending lengthwise and securing a flap portion for covering shoelaces.

Harrell, U.S. Pat. No. 4,507,882, discloses a detachable shoe pocket system that can be installed on a lace-type shoe and which includes a pocket with a top portion for receiving and holding a key or other items.

Gamm, U.S. Pat. No. 4,547,982, discloses a shoe with a wraparound strap including a pocket formed therein for holding personal items.

Lin, et al., U.S. Pat. No. 4,571,856, discloses a double-laced athletic shoe having an upper strap extending about the upper edge of the shoe. The upper strap partially covers the shoelaces of the shoe.

Chassaing, U.S. Pat. No. 4,577,419, discloses a shoe having a strap that extends diagonally across the upper edge of the shoe. The strap partially covers the shoelaces of the shoe.

DeRenzo, U.S. Pat. No. 4,640,025, discloses a figure-eight shoe tie system having an elongated strap that passes under the arch of a users foot, over the top of the shoes, and encircles the user's ankles to produce a generally figure-eight shaped wrapping configuration. The shoelaces of the shoe are partially covered by the wrapping configuration.

O'Rourke, et al., U.S. Pat. No. 4,676,011, discloses an athletic shoe with a strap that extends over the top of the instep. The shoe includes a Y-shaped spring to provide support.

Silverman, U.S. Pat. No. 4,724,623, discloses footwear for infants and toddlers including a strap at an upper end of the shoe.

Malloy, III, U.S. Pat. No. 4,766,682, discloses a removable lace cover strap that extends about the entire shoe and over the instep thereof, partially covering the shoelaces of the shoe.

Brecher, U.S. Pat. No. 4,780,936, discloses a velcro band secured to the tongue of the footwear for extending about a knot tied in shoelaces.

Arnt, U.S. Pat. No. 4,790,048, discloses a shoelace lock having upper and lower plates that cross and grip the laces. The plates are locked onto each other by a snap lock mechanism for securing the shoelaces in a closed position.

Walls, U.S. Pat. No. 4,879,787, discloses a shoelace knot securing device having a body with a loop at one end and two straps at the other end. The body is attached to the shoe by shoelaces extending through the loop. After the shoelace is tied, the straps are placed about the shoelaces, and the free ends of the straps are interconnected with the body to secure the laces in a closed position.

Anderson, U.S. Pat. No. 4,949,437, discloses a shoelace knot retaining apparatus having a rigid member with a lace slot interconnected with a band. The band includes a clip for receiving an end of the rigid tab member. The shoelace is tied over the band portion and the rigid tab member is secured thereupon, the knot being maintained in the lace slot.

Carlton, Sr., U.S. Pat. No. 4,969,242, discloses a tied shoelace shield having a lower member with holes for placement on shoelaces. The shoelace knot is tied over the bottom member, and the shoelaces are positioned on the bottom member. A top member covers the bottom member to retain the tied shoelace within the cavity.

Miller, U.S. Pat. No. 4,999,888, discloses a shoelace retainer including a flexible, elongated strap with hook and pile elements along the length thereof. The shoelaces are passed through a slot at an end, tied, and placed on the strap. The strap is then rolled on itself such that the hook and fastener elements are interlocked to confine the free ends of the shoelaces within the strap.

Williams, U.S. Pat. No. 5,042,119, discloses a securement, concealment and containment of footwear lace ends that are affixed to a shoe and encloses the tied lace ends. A number of embodiments are disclosed, each connecting along the length of the shoelaces. Coins or other personal effects can be stored therein.

Curry, U.S. Pat. No. 5,109,614, discloses a convertible athletic shoe having a low top and a high top configuration, wherein the high top is interconnectable with the low top by a fastening means extending about the lower perimeters of the high and low tops. The shoe includes a strip folded over on itself to conceal the fastener portion of the low top. A shoelace is interconnected with lacing for assisting in connecting the high top with the low top. Also, a strap is provided to extend about the ankle and over the upper and lower portion to augment ankle support.

Melcher, U.S. Pat. No. 5,307,569, discloses a foot support comprising a cover that is interconnectable with the shoe for securing the shoe about a foot, without requiring the use of shoelaces.

Birch, Sr. U.S. Pat. No. 5,311,679, discloses a shoe pocket that is interconnectable with shoelaces and can be partially positioned underneath the laces of the shoe for holding personal items.

Fields, et al., U.S. Pat. No. 5,351,370, discloses a bootlace storage device comprising a strap of flexible material secured about the upper portion of a boot, the device receiving laces for storage. Hooks are provided at the ends of the strap for interconnection with the shoe.

Lubrani, et al., U.S. Pat. No. 5,402,589, discloses an apparatus for securing a shoelace. The apparatus is coupled to the tongue of a shoe and has jaw members with a space therebetween for positioning a tied shoelace, the jaws being biased in a closed position to secure the tied shoelace therein.

Bemis, et al., U.S. Pat. No. 5,416,987, discloses a closure for footwear having an instep strap with ends on opposite sides of the foot. The straps have pulleys interleaved with the tongue of the shoe. A foldable fastening tab is attachable to the tongue of the shoe.

Emrick, U.S. Pat. No. 5,421,106, discloses a removable shoe string cover for athletic shoes, having an upwardly-facing wiping surface. The cover can be held in place by hook and loop type fasteners.

Richardson, U.S. Pat. No. 5,430,960, discloses an ankle support system. The system includes a sock-like brace for covering one's feet. The brace is attached to the tongue. A strap is provided at the upper end of the shoe to secure the shoe and support system about a wearer's foot.

Lasher, U.S. Pat. No. 5,459,947, discloses a decorative shoe tongue and lace securing device positioned below the laces of the shoe, and an upper cover which is attachable to the strip by hook and pile type fasteners. The laces and knot are sandwiched between the strip and the cover.

Mathis, et al., U.S. Pat. No. 5,566,477, discloses a removable shoelace cover for a shoe that is secured to the shoe by a number of straps threaded through slots in the shoelace cover.

Gourley, U.S. Pat. No. 5,671,517, discloses a shoe lace safety guard having an outer cover folded over a lower cover, wherein the tied laces are stored therebetween. The safety guard is held in place by hook and loop type fasteners.

Parker, et al., U.S. Pat. No. 5,692,319, discloses a wrap closure and fit system for encircling the sole or attaching to the sole of a shoe to increase the tension distributed around the shoe upper. Further, the system conforms the shoe upper to the midsole shape of the foot.

Crowley, U.S. Pat. No. 5,701,688, discloses a shoelace cover with a translucent window, the cover secured to the upper of the shoe to display and protect the lacing.

Veylupek, U.S. Pat. No. 5,755,044, discloses a shoe lacing system having anchor elements attached to the shoelace. The anchor elements are attachable by hook and loop fastener means to a rear area of the shoe. The anchor elements are pulled to tighten the laces along the tongue of the shoe, and then positioned against the rear foot of the shoe to secure the lace.

Peterson, U.S. Pat. No. 5,771,608, discloses a shoe with ankle strap protector for extending about the upper portion of the shoe.

Illingworth, U.S. Pat. No. 5,778,500, discloses a knot securing device having a backing and a cover. The shoelaces are passed through the backing and a knot is tied on top of the backing. The cover is pressed down and secured to the backing to cover the shoelace knot.

Fattori, U.S. Pat. No. 5,867,925, discloses a shoe tassel retainer to maintain and/or reform a shoe flap, and tassels which include a first loop for fitting about the shoe and a second loop for fitting about and retaining the tassels.

Deskins, et al., U.S. Pat. No. 6,000,111, discloses a device for containing, concealing and protecting footwear fasteners, including a bottom portion for the shoelaces to pass through and for supporting a tied shoelace knot, and an upper that is attachable to the lower to retain the shoelace knot.

Additionally, there have been discussions relating to requiring covers for covering the shoelaces of wrestling shoes to prevent them from becoming untied during wrestling matches.

Accordingly, what is desired, and has not heretofore been developed, is a shoelace cover that can be used in connection with an athletic shoe to cover a tied shoelace bow and to prevent the loosening, untying or entanglement thereof.

OBJECTS AND SUMMARY OF THE INVENTION

It is an object of the present invention to provide a shoelace cover for an athletic shoe.

It is a further object of the present invention to provide a shoelace cover that can be used with any type of shoe.

It is another object of the present invention to provide a shoelace cover that can be quickly and easily attached to and detached from a shoe.

It is an additional object of the present invention to provide a shoelace cover which is easy to use.

It is even an additional object of the present invention to provide a shoelace cover which is inexpensive to manufacture.

It is still an additional object of the present invention to provide a shoelace cover which is simple in construction.

It is a further object of the present invention to provide a shoelace cover which entirely covers a tied shoelace bow.

It is still a further object of the present invention to provide a shoelace cover which includes a pocket for receiving and holding a tied shoelace bow.

It is yet another object of the present invention to provide a shoelace cover which is interconnected with a shoe by shoelaces extending therethrough.

The present invention relates to a shoelace cover for use with an athletic shoe for covering the shoelaces to prevent the loosening or untying of a tied shoelace bow. The present invention is particularly applicable to wrestling shoes wherein the physical contact between wrestlers often causes the wrestling shoes to become untied. The shoelace cover generally includes a length of material with ends that can be interconnected to form an adjustable cuff for extending about one's ankle. A front portion includes apertures for shoelaces to extend through the cover. Preferably, the shoe laces extend from the shoe and then pass through the apertures of cover and then back to the shoe to secure the cover to the shoe. The front portion includes a pocket on a back side. The shoelaces can be tied into a shoelace bow, tucked into the pocket, and the ends of the cuff can be secured about one's ankle to retain the shoelace within the pocket under the cover.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a shoelace cover for use in connection with an athletic shoe to cover the tied shoelace bow knot to prevent same from becoming untied, loosening, or interfering with an activity being performed. The shoelace cover is interconnected with an athletic shoe via the shoelaces and extends about the shoe and one's lower foot or ankle to cover the tied shoelace knot.

Figure 1:
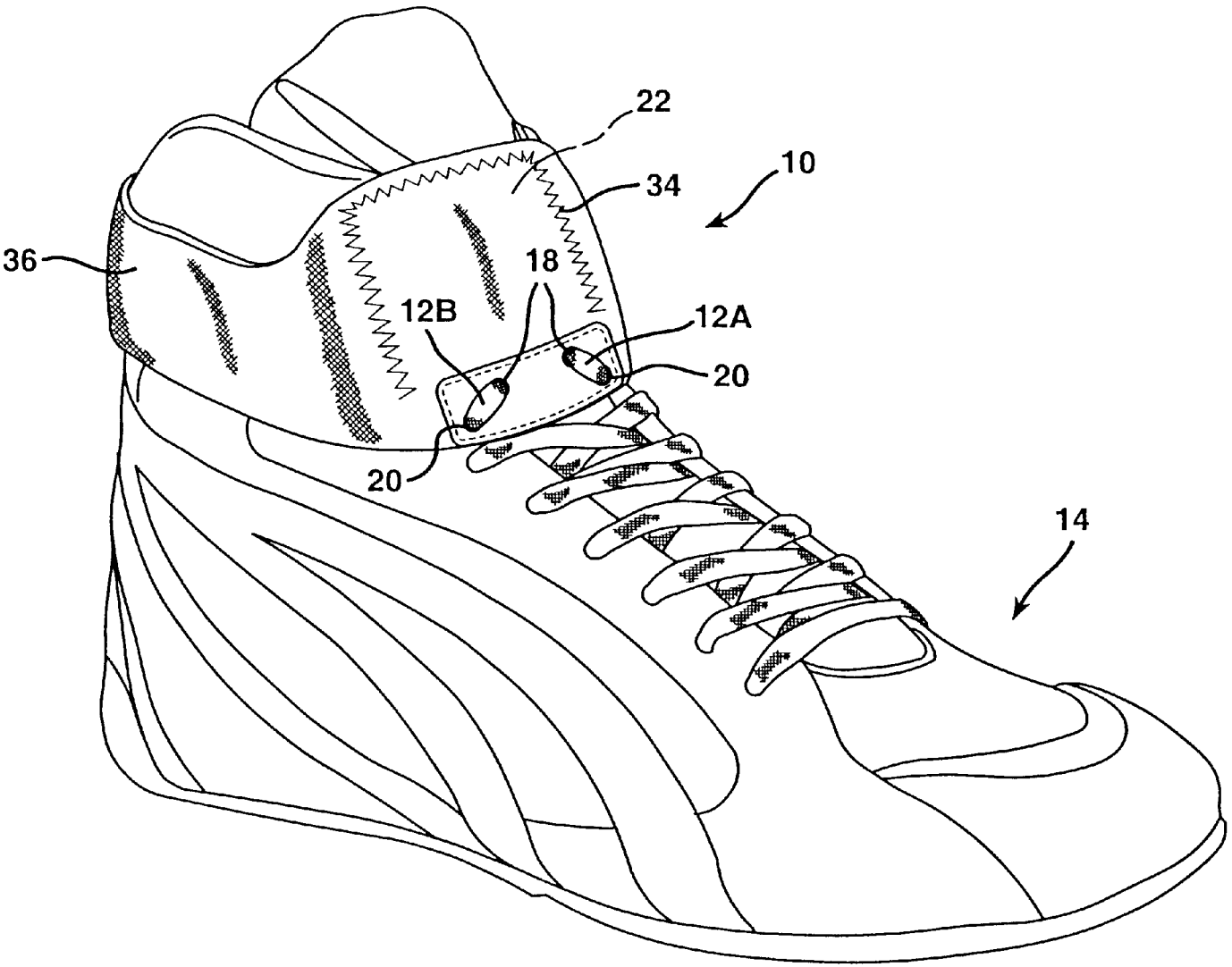
FIG. 1 is a perspective view showing an athletic shoe with an embodiment of the shoelace cover of the present invention positioned thereon.

FIG. 1 shows the shoelace cover of the present invention, generally indicated at 10, interconnected with an athletic shoe, generally indicated at 14, by means of first and second shoelace ends 12A and 12B extending through apertures provided in the shoelace cover. The shoelace cover 10 is interconnected around one's lower leg or ankle and extends about an upper portion of the shoe and retains the tied shoelace knot 40 (not shown) in position behind the shoelace cover 10.

Figure 2:
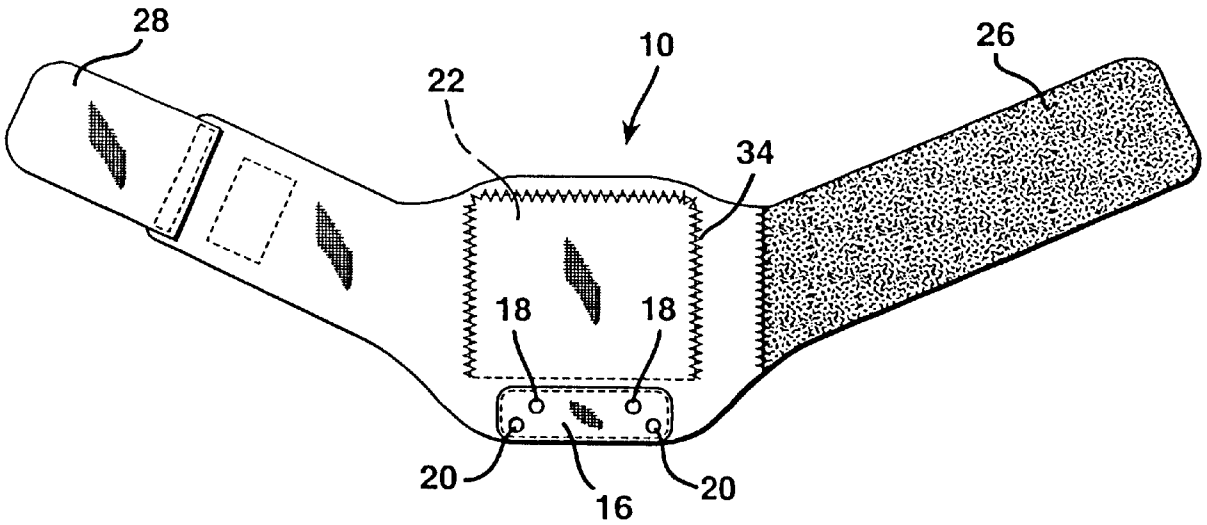
FIG. 2 is a front view of the shoelace cover shown in FIG. 1 for a left shoe.

As shown in FIG. 2, the shoelace cover 10 includes a lower end having bottom holes 20 and top holes 18. These holes 20 and 18 allow for interconnection of the shoelace cover 10 with the shoe 14 via laces as will be hereinafter described. Preferably, a reinforcement strip 16, made of, for example, leather, or a leather-like material, or other reinforcing material, is mounted to the front of the shoelace cover 10, surrounding holes 18 and 20, to provide strength thereto. As shown, it is desirable that the lower or bottom holes 20 are spaced wider apart than upper or top holes 18, so that when the shoelaces are passed through the holes 18 and 20, to interconnect the cover with a shoe, the shoelaces are properly oriented towards the next eyelet along the shoe.

A pocket 22 is defined on the shoelace cover 10 by a stitched boundary 34 on three sides thereof to provide a pocket 22 with an open end facing the holes 18 and 20, i.e. facing downward/frontward when in use. The pocket 22 is positioned on the back face of the shoelace cover 10, i.e. against the shoe upper when in use. The pocket 22 is sized to receive the tied shoelaces therein.

The shoelace cover 10 additionally includes extending arms that can be interconnected together about an upper end of the shoe 14 and a user's leg or ankle. The means for interconnecting the arms preferably comprises a hook and fastener system. As shown in FIG. 2, a loop material 26 is positioned on one arm and a tab 28 on the other arm supports a hook portion of the hook and loop fastener system as indicated by reference number 24 in FIG. 4. Clearly, the hook and loop fasteners can be positioned on either arm as desired. Further, it is within the scope of the present invention that other known connecting devices may be used to connect the arms of the shoelace cover 10 about a user's leg or ankle.

Figure 3:
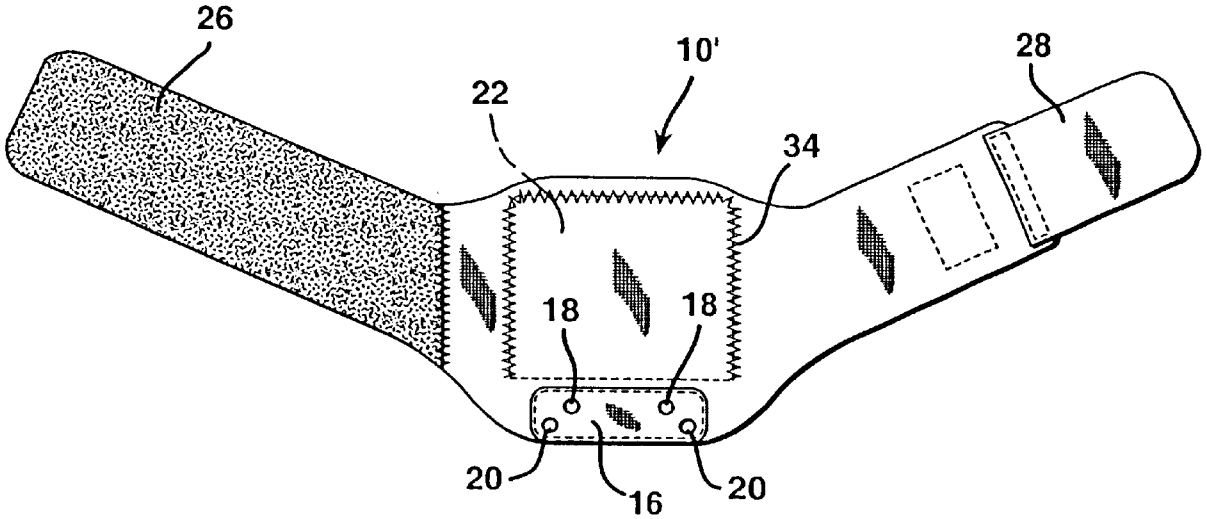
FIG. 3 is a front view of the shoelace cover shown in FIG. 1 for a right shoe.

FIG. 3 is a front view of the shoelace cover of the present invention for a right foot. The right foot version, generally indicated as 10', is of a similar construction to the left foot version and includes a lower end having bottom holes 20 and top holes 18 for interconnection of the shoelace cover 10 with the shoe 14. Preferably, a reinforcement strip 16 is provided on the front of the shoelace cover 10' and a pocket 22, defined by a stitched boundary 34 on three sides is provided on the back side. The shoelace cover 10 additionally includes arms that can be interconnected together about a user's leg or ankle.

Figure 4:
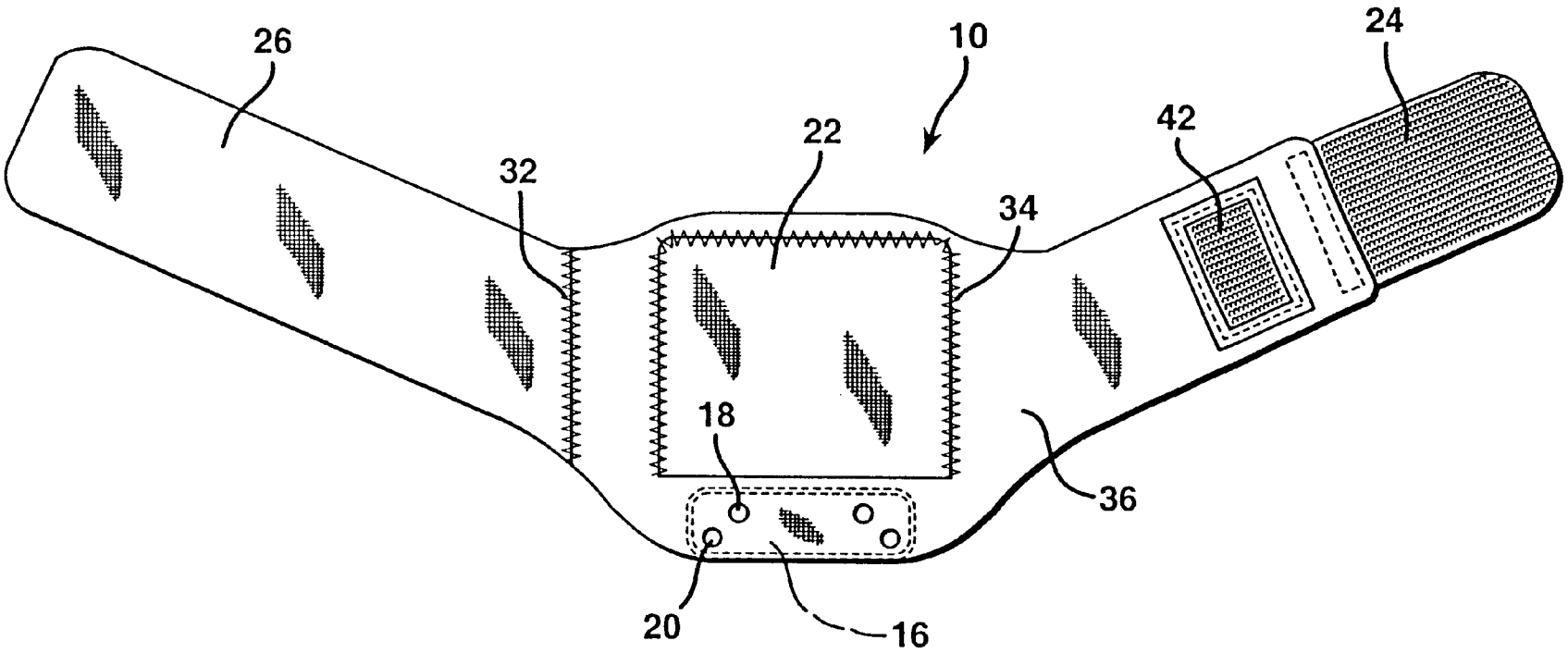
FIG. 4 is a rear view of the shoelace cover for a left shoe shown in FIG. 2.

FIG. 4 is a back view of the shoe cover 10 shown in FIG. 2. As can be seen, the top and bottom holes 18 and 20 extend through the reinforcement strip at a lower end of the shoe cover 10 and the pocket 22 can be seen. The fastener system includes loop material 26 attached to the front panel by a stitch seam 32, and a patch of hook material 42 and a hook portion 24 is provided on tab 28.

The material used in the construction of the shoelace cover is preferably a laminated nylon and Neoprene structure, i.e., a fabric/foam structure and is indicated at reference number 36. Of course any suitable material, or combination of materials, could be used to construct the shoelace cover of the present invention. It is desirable that the material be durable to withstand physical contact, soft to prevent injury and elastic and flexible to provide a snug fit.

Figure 5:
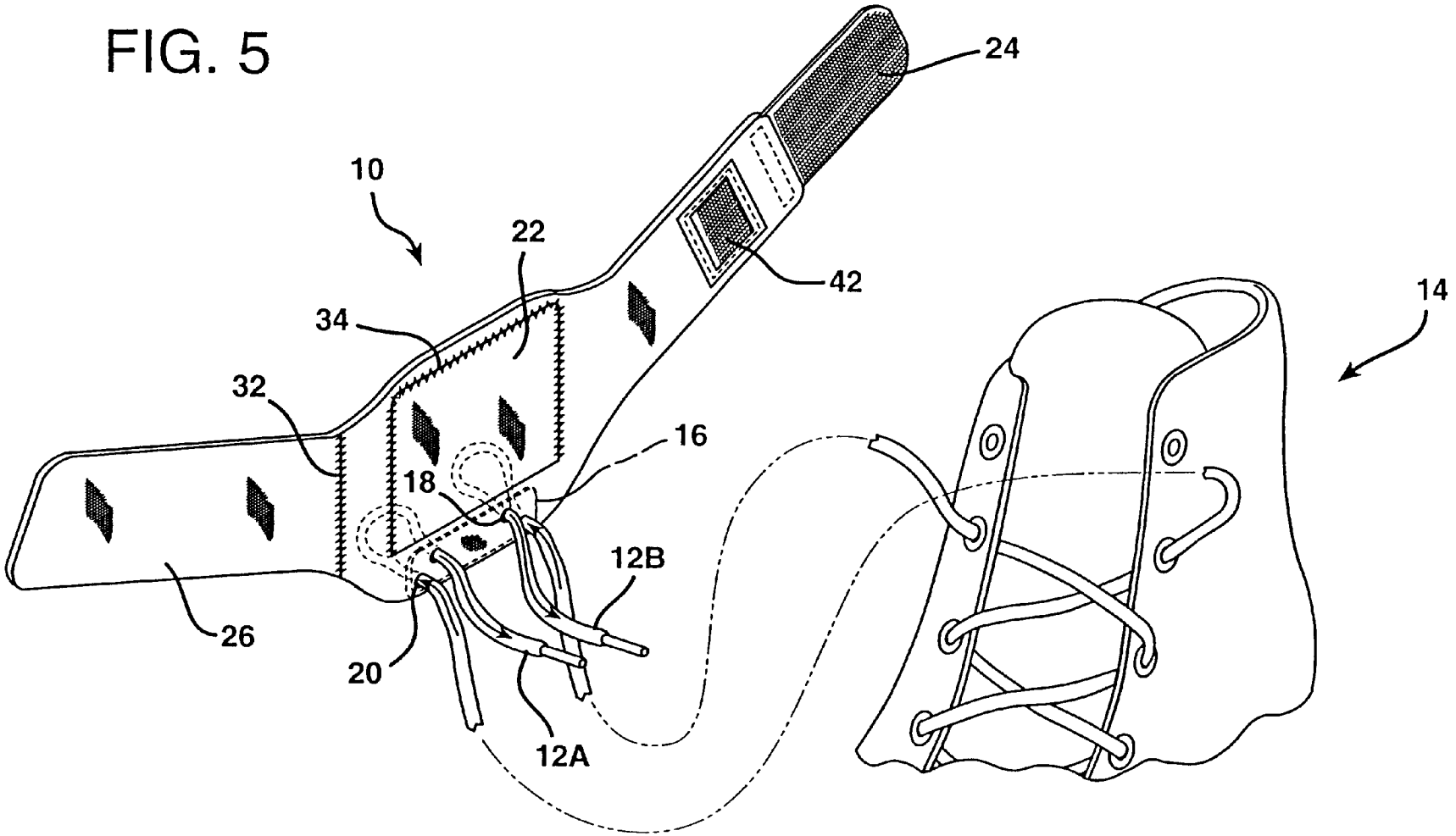
FIG. 5 is a perspective view of the shoelace cover shown in FIG. 1, and a portion of a shoe, showing the shoelaces threaded through shoelace holes in the shoelace cover.
Figure 6:
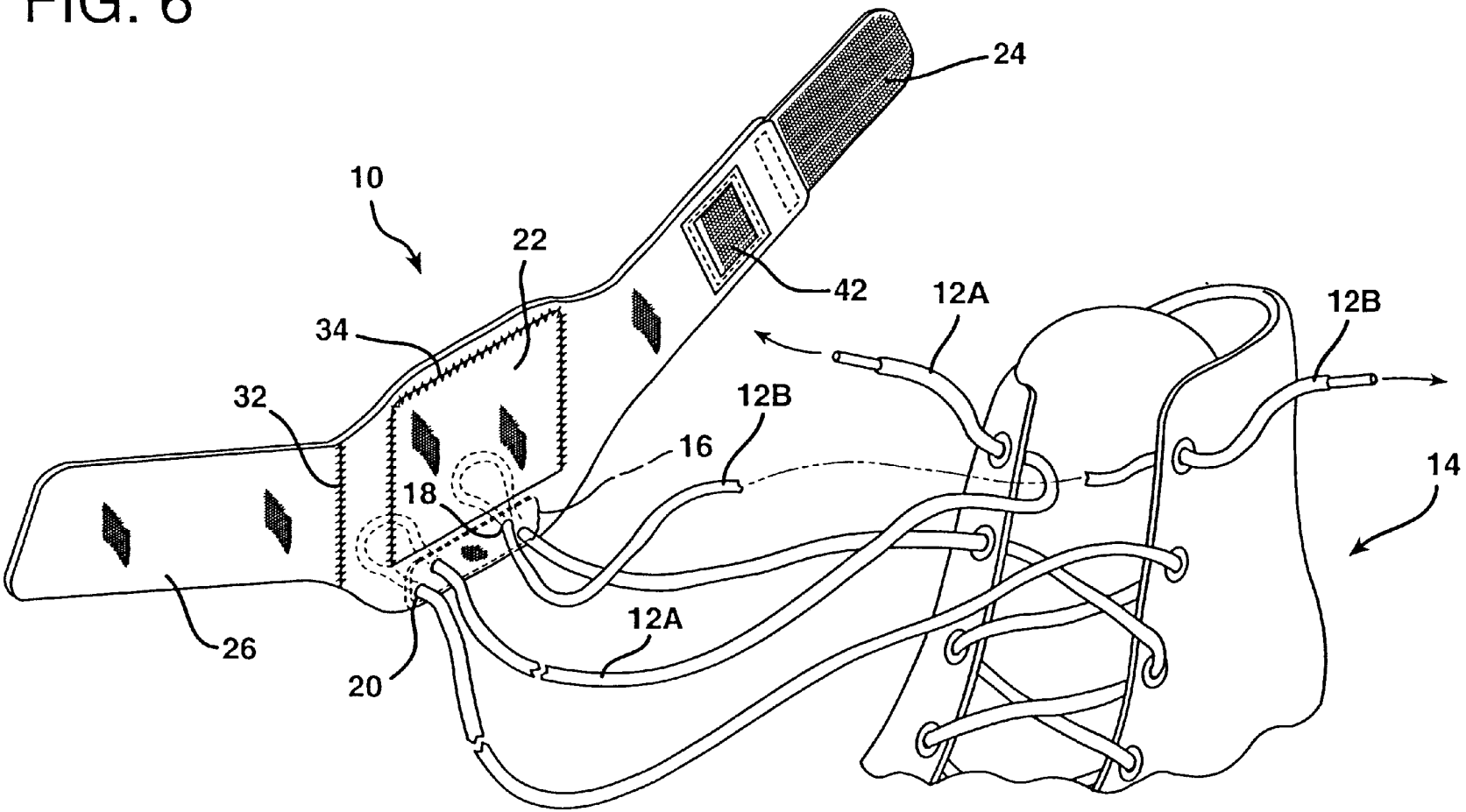
FIG. 6 is a perspective view of the shoelace cover shown in FIG. 5 further showing the shoelaces leaving the shoelace cover and threaded back through the shoelace holes of a shoe to secure the shoelace cover to the shoe.

FIG. 5 shows the shoelace cover 10 in the process of being interconnected with shoelaces of a shoe 14. For example, at a position near the upper edge of the throat of the shoe, before the upper eyelet or shoelace aperture, the ends of the shoelaces 12A and 12B are threaded out from an eyelet of the shoe, through the bottom holes 20 of the shoelace cover 10 and then back through the top holes 18 of the shoelace cover 10. As shown in FIG. 6, the ends of the shoelaces 12A and 12B are then threaded through the upper most eyelets of the shoe 14. By threading the shoes laces through the shoelace cover 10, the cover is retained, at its lower end, against the shoe.

Figure 7:
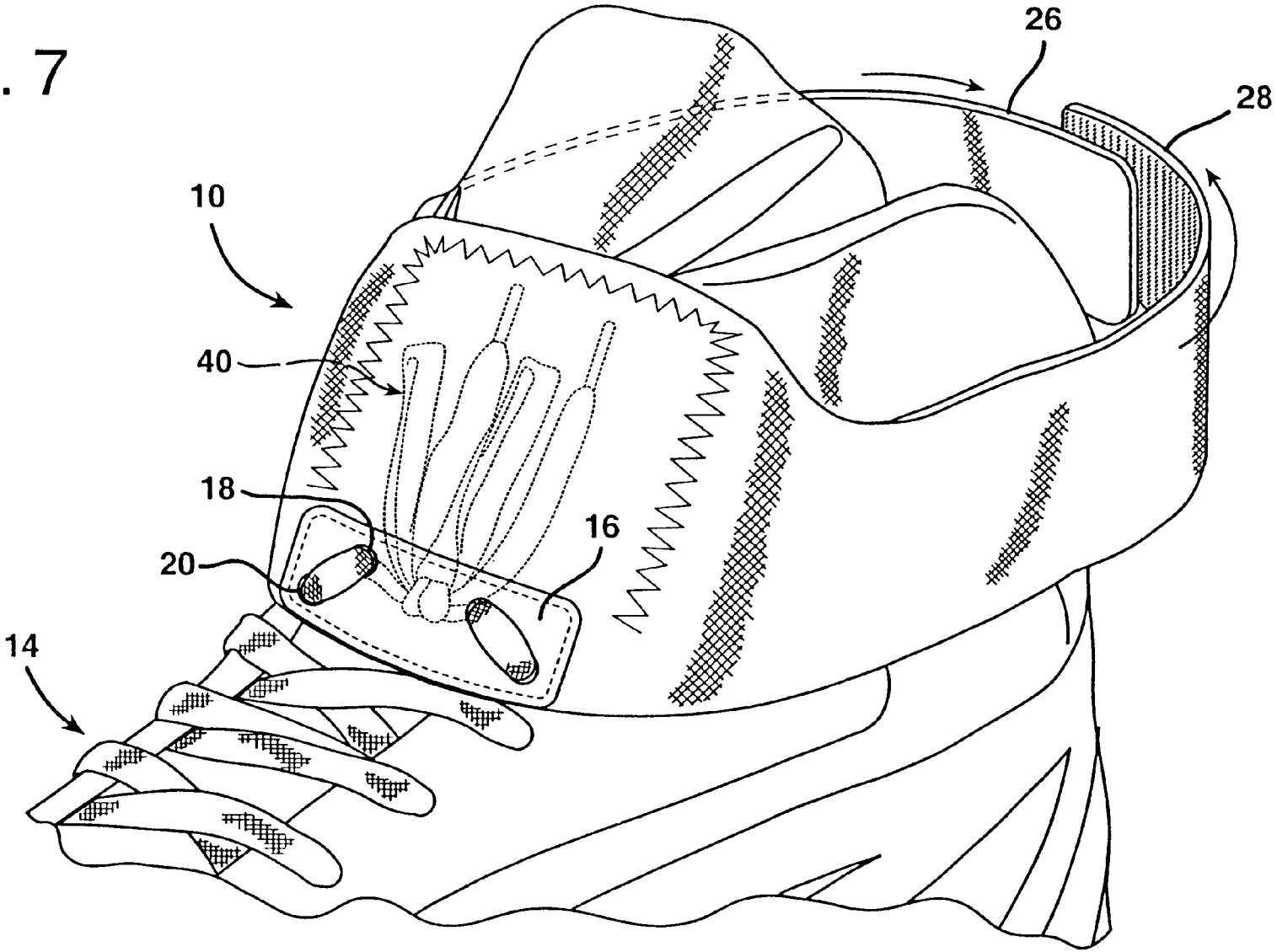
FIG. 7 is a perspective view of the shoelace cover shown in FIG. 6 with the shoelace tied in a bow and positioned within a pocket on the shoelace cover, and the ends of the cover attached about the shoe.

As shown in FIG. 7, when everything is pulled tight, the shoelace cover 10 is positioned adjacent to the upper edge of the shoes. Thereafter, the shoelaces 12A and 12B can be tied and the bow and shoelace ends can then inserted into the pocket 22 for covering and preserving the tied shoelace bow.

Figure 8:
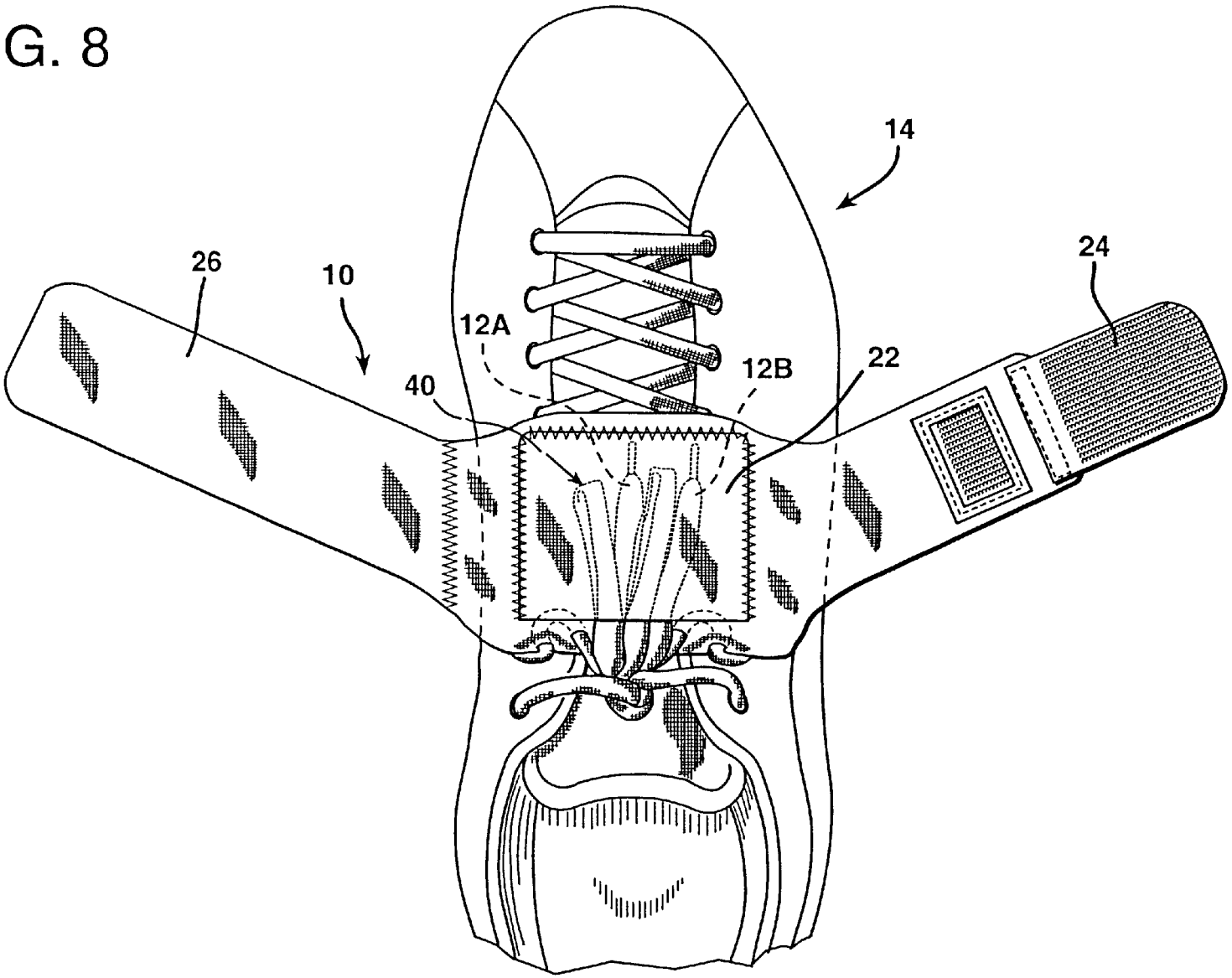
FIG. 8 is a top view of the open shoelace cover shown interconnected with a shoe and the shoelace bow tucked into a pocket provided on the shoelace cover.

FIG. 8 is an upper view of the tied shoelaces shown with the ends of the shoelaces 12A and 12B threaded through the cover and then through the upper eyelets of the shoes. When the shoelace cover is in this position, the shoelaces can be tied. Then the shoelace ends and bows can be inserted into the pocket 22. Thereafter, the shoelace cover is rotated up against the user's lower foot, and the arms wrapped about the user's leg or ankle, and the hook and loop fastener system is engaged to securely hold the shoelace cover 10 about the lower leg of a user to retain the shoelaces 12A and 12B within the pocket 22.

Figure 9:
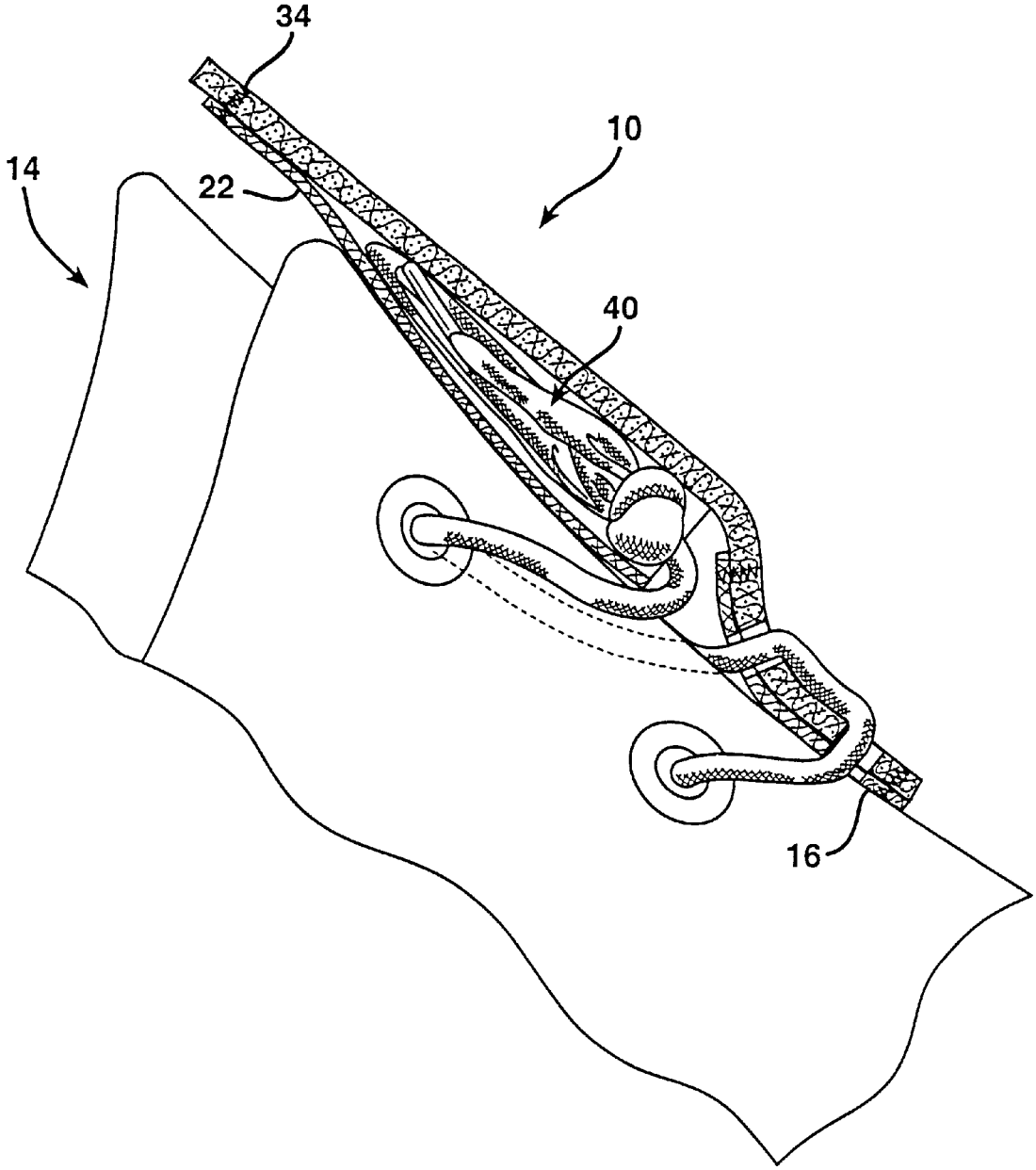
FIG. 9 is a cross sectional view of the shoelace cover interconnected with a shoe by the shoelaces and showing a shoelace bow knot tucked into the pocket of the cover.

FIG. 9 is a cross sectional view showing the tied shoelace bow 40 positioned within the pocket 22 of the shoelace cover 10. When the ends of the shoelace cover 10 are interconnected about the lower leg of the user, the shoelace cover 10 is pulled tight around the upper edge of the shoe to firmly retain the shoelace cover 10 against the shoe 14 and to firmly retain the tied shoelace bow 40 within the pocket 22.

Figure 10:
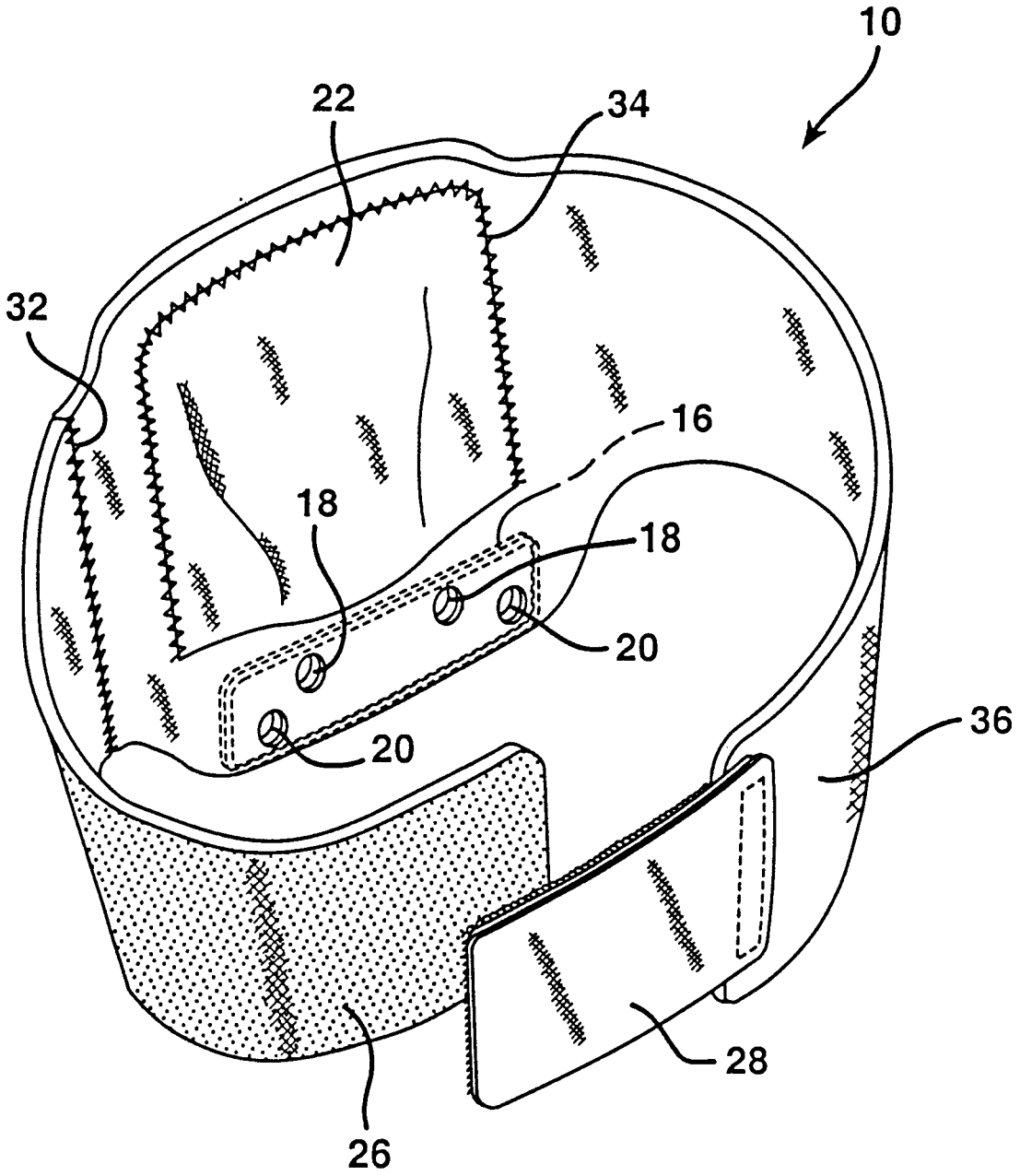
FIG. 10 is a perspective view of the shoelace cover of the present invention.

FIG. 10 is a perspective view of the shoelace cover 10 in a position wherein the arms of the shoelace cover 10 are bent around in position similar to which they would engage with the tab 28 which supports hook material 24 positioned in alignment with the loop material 26 on the other arm. As shown, when the arms are engaged the shoelace cover 10 forms a cuff and extends about the lower leg or ankle of a user to hold the shoelace cover 10 against the shoe and to retain a tied shoelace bow 40 within the pocket 22 to prevent the tied shoelace bow 40 from becoming loosened, untied or interfering with a user's activities.

Having thus described the invention in detail, it is to be understood that the foregoing description is not intended to limit the spirit and scope thereof. What is desired to be protected by Letters Patent is set forth in the appended claims.

What is claimed is:

1. A shoelace cover comprising:

a central portion having upper and lower faces;

shoelace eyelets extending through the central portion for receiving shoe laces;

a pocket formed on the lower face of the central portion for accepting ends of tied shoelaces;

first and second arms extending from the central portion; and connecting means for connecting the first and second arms about a leg or ankle of a user.

2. The shoelace cover of claim 1 wherein the pocket comprises a swatch of material stitched to the lower face of the central portion.

3. The shoelace cover of claim 2 wherein the pocket includes an open end positioned proximate to the shoelace eyelets.

4. The shoelace cover of claim 3 wherein the eyelets comprise two pairs of eyelets.

5. The shoelace cover of claim 4 wherein a lower pair of eyelets are positioned at a lower end of the central portion, and an upper pair of eyelets are positioned above the lower pair, the upper pair of eyelets positioned closer together than the lower pair.

6. The shoelace cover of claim 5 wherein the connecting means for connecting the first and second arms about a leg or ankle of a user comprise hook and pile type fasteners.

* * * * *